United States Patent [19]

Iesaka et al.

[11] Patent Number: 4,638,618

[45] Date of Patent: Jan. 27, 1987

[54] DECORATIVE PANELS COMPRISING REPLACEABLE DECORATIVE SHEETS

[75] Inventors: Takashi Iesaka, Tokoname; Takaaki Wada, Handa; Ikumi Ohta, Mie; Masayuki Izumi, Setagaya, all of Japan

[73] Assignees: Inax Corporation; Japan Alpha Corporation, both of Japan

[21] Appl. No.: 753,415

[22] Filed: Jul. 10, 1985

[30] Foreign Application Priority Data

Mar. 4, 1985 [JP] Japan ..... 60-30471

[51] Int. Cl.[4] ..... E04F 13/00

[52] U.S. Cl. ..... 52/509; 52/36

[58] Field of Search ..... 52/509, 36, 512, 506

[56] References Cited

U.S. PATENT DOCUMENTS

| | | | |
|---|---|---|---|
| 2,201,129 | 5/1940 | Weiland | 52/509 |
| 2,341,777 | 2/1944 | Hensel | 52/509 X |
| 2,968,033 | 1/1961 | Kreitzberg | 52/509 X |
| 3,181,664 | 5/1965 | Aagaard | 52/509 X |
| 3,733,756 | 5/1973 | Butler | 52/36 |
| 4,204,665 | 5/1980 | Sherwood | 52/509 X |
| 4,430,837 | 2/1984 | Kirshenbaum | 52/512 |
| 4,519,173 | 5/1985 | Roberts | 52/509 X |

FOREIGN PATENT DOCUMENTS

| | | | |
|---|---|---|---|
| 563673 | 8/1944 | United Kingdom | 52/509 |
| 732473 | 5/1980 | U.S.S.R. | 52/509 |

*Primary Examiner*—J. Karl Bell

*Attorney, Agent, or Firm*—Lerner, David, Littenberg Krumholz & Mentlik

[57] ABSTRACT

A novel decorative panel comprises specified rigid decorative sheets replaceably installed on a structural support such as frame works, substrate boards or walls. Such decorative sheets can be readily installed or replaced by the use of removable fixing means such as screws. The decorative sheet is characterized by cutouts at the corners thereof and depressions adjacent to the cutouts. When four decorative sheets are assembled together, the assembled corners of the sheets form a cut-out hole where a fixing means is inserted and a depression around the hole where the head of the fixing means is recessed. By utilizing the heads of fixing means, a variety of decorative accessories or articles can be further set on the decorative panel by means of pins, hooks, rods or magnet pieces.

20 Claims, 7 Drawing Figures

DECORATIVE PANELS COMPRISING REPLACEABLE DECORATIVE SHEETS

BACKGROUND OF THE INVENTION

1. Field of the Invention

This invention relates to a novel decorative panel comprising specified rigid decorative sheets replaceably installed on a structural support. Such decorative sheets can be readily installed or replaced to exhibit a variety of designs by the use of fixing means such as screws. Moreover, a variety of decorative accessories such as a picture frame can be further set on the decorative surfaces. Such readily replaceable decorative panels are very useful, for example, for display rooms, etc.

2. Prior Art

Most of tile panels have been produced by bonding tile pieces onto a substrate with wet mortar. Such wet installation of tile needs professional skills and long working time, may sometimes cause the freshly bonded tile to slip down, and also needs long aging time. Moreover, a considerably large-scale work is required to replace the tile pieces when the panel is remodeled.

Installation of decorative sheets such as tile with strong organic adhesives also has difficulty in partly stripping the sheets and cleaning the adhesive, when the panel is remodeled. Some decorative sheets can be nailed onto a substrate. Such nailing installation, however, needs to grout the nail heads. The grout and nails have to be removed when the decorative sheets are replaced. A considerably large-scale work is also required in these dry installation systems, when the panel is remodeled.

Thus, it is an object of the present invention to provide a decorative panel comprising rigid decorative sheets which are replaceably installed on a structural support by the use of fixing means such as screws.

Another object of the present invention is to provide the above mentioned decorative panel on which a variety of decorative accessories or articles are readily set by utilizing the heads of the fixing means.

Other objects and features of the present invention will become apparent from the following description.

SUMMARY OF THE INVENTION

In accordance with the present invention, there is provided a decorative panel 1 which comprises right-angled tetragonal rigid decorative sheets 2 replaceably installed on a structural support 9 such as frame works, substrate boards or walls by the use of removable fixing means such as screws 6; said decorative sheet 2 having cutouts 3 at the corners thereof and depressions 4 adjacent to the cutouts; each of corners of four sheets 2 closely assembled together forming a cut-out hole 5 and a depression 4 around the hole; said structural support 9 containing mating fixing means such as internal screw-thread means 15; the cut-out holes 5 of the assembled sheets being arranged on the mating fixing means 15; the fixing means 6 being fitted to the mating means 15 through the cut-out holes 5; the flanges 7 at the heads of the fixing means being recessed on the depressions 4 around the holes 5; whereby the decorative sheets 2 being replaceably fixed onto the structural support 9.

The decorative sheets are normally assembled without substantial gaps. It is generally preferred in view of appearance that the heads of the fixing means recessed on the depressions 4 are not higher than the level of the decorative surface. Incidentally, a covering frame 12 can be applied onto an edge or edges of the decorative panel 1. In this case, it is not always needed to secure such covered parts of the decorative sheets by the fixing means. Moreover, other decorative articles can be set on the decorative panel 1 by means of accessories or magnetic force. In the latter case, either one of some fixing means and decorative sheet(s) or the decoration article contains magnet pieces, and the other contains magnetizable pieces.

Incidentally, the decorative sheets are generally assembled and installed from the bottom row of the decorative sheets. The decorative sheets can be readily installed or partly replaced to provide a variety of the decorative panels by those unskilled in the art, when the decorative sheets, structural supports and other accessories are supplied. Also, the decorative panel itself can be readily set or replaced to remodel the decorative designs.

DESCRIPTION OF PREFERRED EMBODIMENTS

Decorative Sheets

Figure 1:
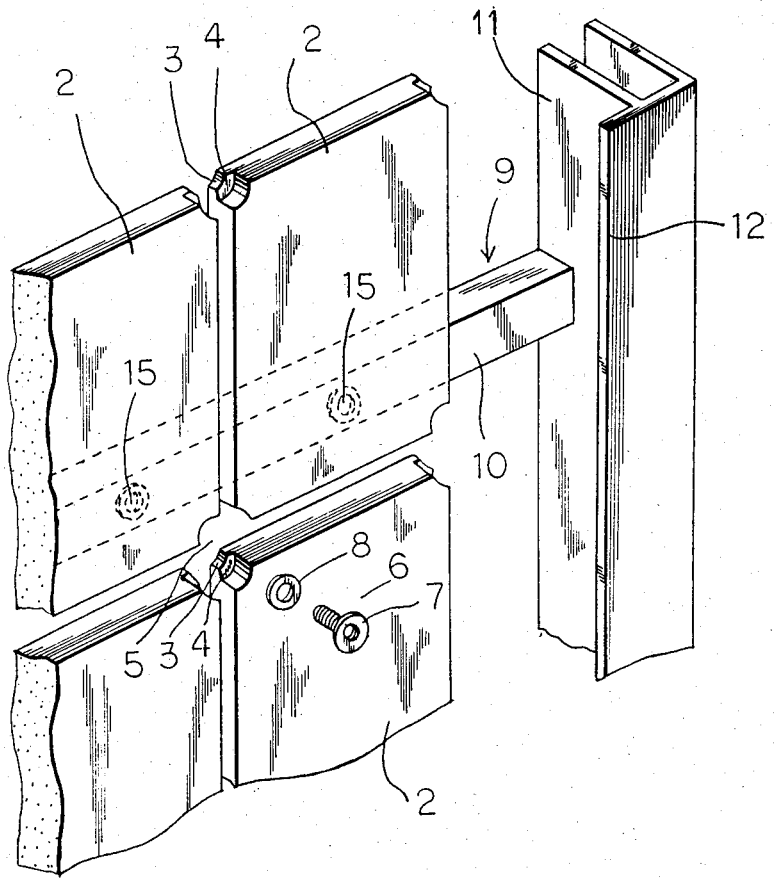
FIGS. 1 and 5 are perspectives illustrating installation of decorative sheets.

The rigid decorative sheets to be used in the present decorative panel can be square or rectangular rigid sheets of plastics, plastic composites, glass, wood, ceramics, cement concrete, metal, mixtures thereof or the like. Heat-resistant sheets such as those of ceramics, concrete or metal can be glazed on the surfaces thereof. The dimensions of the decorative sheets are not especially restricted, but are normally in the range of about 10 cm to about 50 cm. The thickness of the sheet is such that sufficient strength is provided. The decorative sheet generally has cutouts 3 and depressions 4 at the four corners thereof. Thus, the cutout and depression at the edges or corners of the panel 1 form semi- or quarter-circle configurations, where the fixing means can be inserted and recessed. As mentioned above, however, such cutouts and depressions are not always needed at the corners or edges which are supported by the covering frame 12 of the decorative panel. The size of the cutout 3 of the sheet is such that the shank of fixing means such as screws 6 can be passed through. The size of the depression 4 is such that the flange 7 at the head of the fixing means can be recessed thereon. Incidentally, the cutouts 3 and depressions 4 are normally designed to comprise quarter-round corners.

Figure 5:
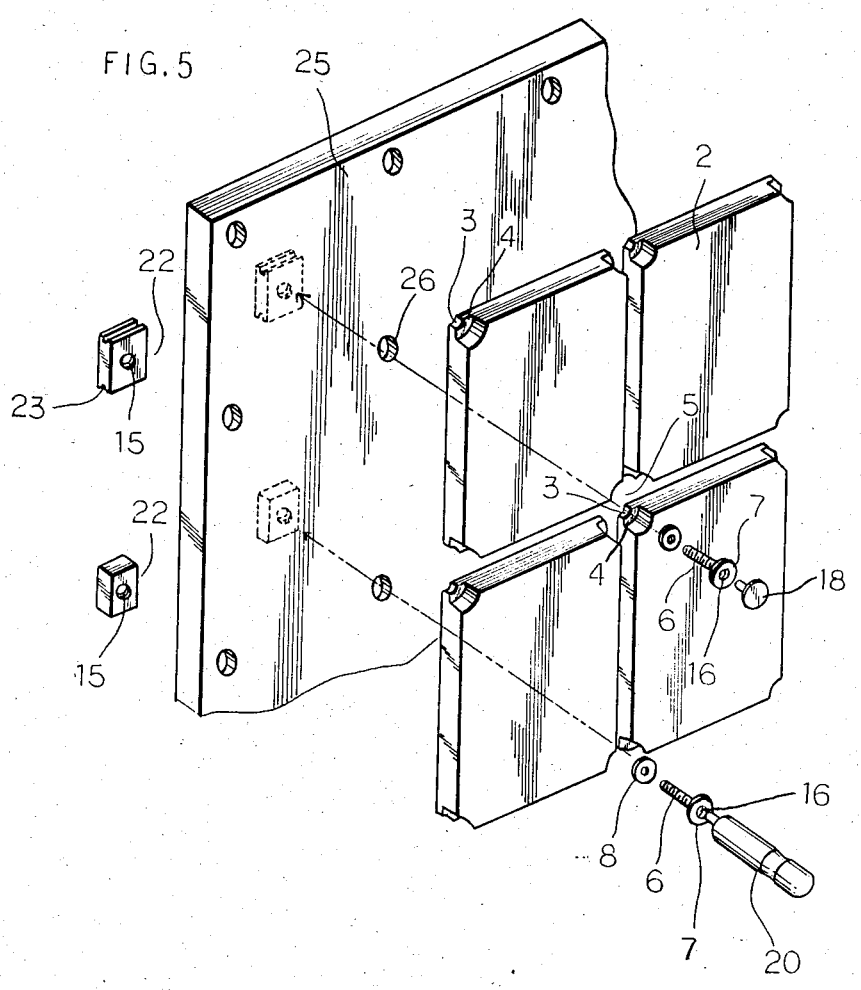

The depression 4 at the corners of the decorative sheet 2 can be in the form of a substantially flat plane lower than the decorative surface as shown in FIGS. 1 and 5 or an inclined plane tapering towards the cutout 3. It has been unexpectedly found that an inclined depression tapering from the decorative surface to the cutout 3 is advantageous to ceramic tile and the like, because the mechanical strength of the tapered corner is ensured owing to gradual change in the degree of compaction and also glaze is uniformly applied onto such tapering depressions.

Embodiment I

The rigid decorative sheets 2 are replaceably installed on a structural support 9 such as a frame work or a wall containing mating fixing means by the use of removable fixing means such as screws 6 to provide the present decorative panel 1. The structural support 9 is exemplified by a frame work composed essentially of horizontal or vertical bars 10 arranged at an interval of the decorative sheet and at least two vertical or horizontal bars 11 supporting the bars 10. The bars 10 have mating fixing means such as internal screw-thread holes 15 or holes 26 combined with nuts, at an interval of the decorative sheet to be installed thereon. Instead of the frame work, the bars 10 can be fixed onto a structural member such as walls or boards.

Figure 2:
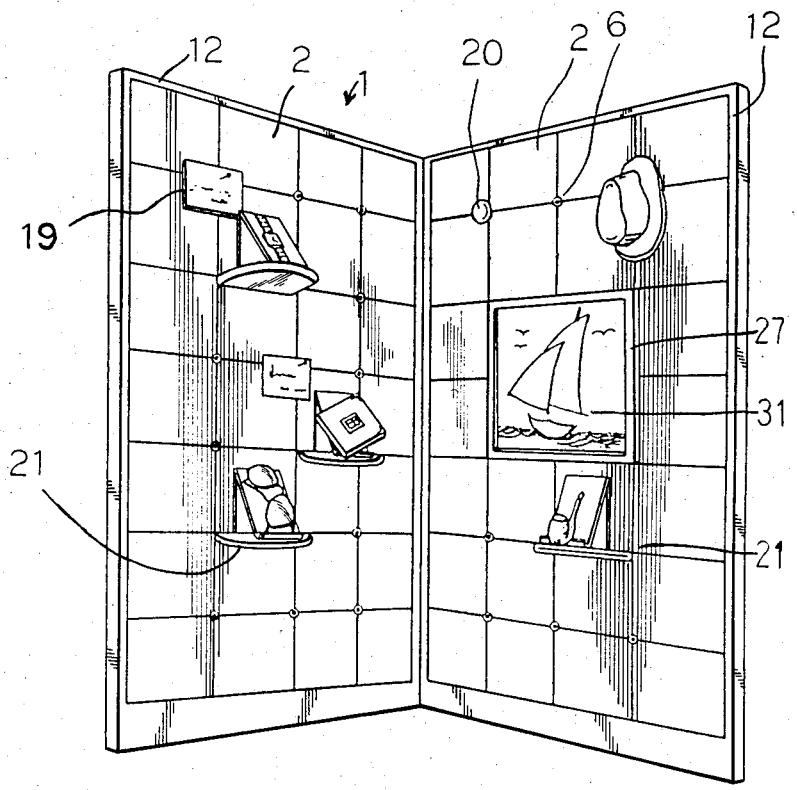
FIG. 2 is a perspective view of the present decorative panel.
Figure 3:
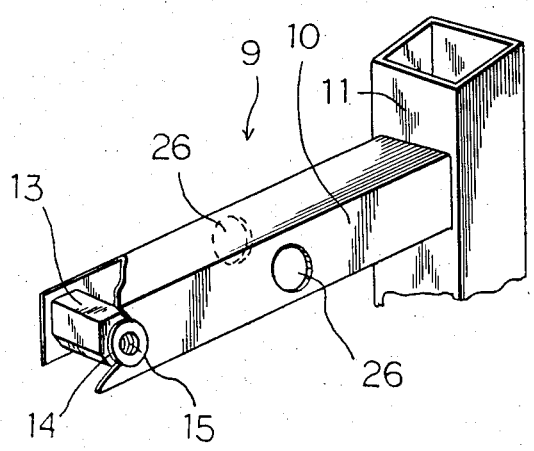
FIG. 3 is a perspective view of a structural support.

In a preferred embodiment, the bar 10 can be a metal bar 10 having U-shaped cross section. The U-shaped bars are composed to form a frame work or fixed onto a structural member with the openings thereof downward or upward or sideways. The U-shaped bars can have holes 26 at the both parallel sides thereof, as shown in FIG. 3. For example, nuts 13 having ring projections 14 at both ends thereof are set between pairs of the holes 26 of the U-shaped bar 10. Alternatively, the bars 10 can have internal screw-thread holes. The decorative sheets 2 can be readily screwed to the structural support 9 by means of bolts 6 and nuts 13 or screw-thread holes as illustrated in FIGS. 1 and 3, to provide a decorative panel such as decorative walls or self-standing screen walls (e.g. a screen with or without casters or a folding screen as shown in FIG. 2). By the use of U-shaped bars 10 and nuts 13 held thereby as shown in FIG. 3, the decorative sheets can be readily installed as necessary on both sides of the frame work 9; such structure is useful for screen walls.

Figure 4:
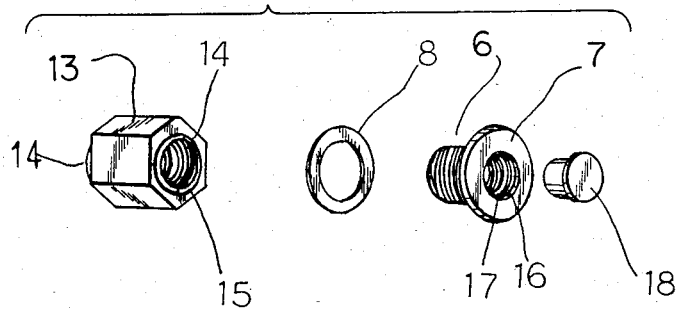
FIG. 4 shows a combination of a bolt, a nut and accessories.

The preferred combination of the bolt 6, nut 13 and other accessories is illustrated in FIG. 4. The fixing means such as a bolt 6 can have an inner hole (e.g. an inner screw-thread hole 16) for holding accessories and screwdriver grooves 17 at the head thereof. The inner hole 16 can hold a decorative head cap 18 or the like. As shown in FIG. 2, the head cap can be of relatively soft materials such as wood or rubber for pinning cards 19 or other displays thereon. Also, the inner holes 16 can be equipped with hooks or hangers 20, magnet pieces, rods for supporting shelf boards 21 or trays, or the like, by means of screws or adhesives, etc. The washer 8 is to protect the corners of decorative sheets, which is normally of relatively resilient materials such as rubber or plastics. The nut 13 normally has polygonal outward surfaces, whereby rotation of the nut is prevented by the bottom of the U-shaped bar as shown in FIG. 3. The length of the polygonal body 13 is as long as the distance between the parallel sides of the U-shaped bar 10, and the size of the ring projection 14 is as large as the diameter of the hole 26 at the sides of the bar 10. Incidentally, the decorative panel having inverted U-shaped horizontal bars can also be readily anchored onto a structural member such as walls by hooking means 24.

EMBODIMENT II

Figure 6:
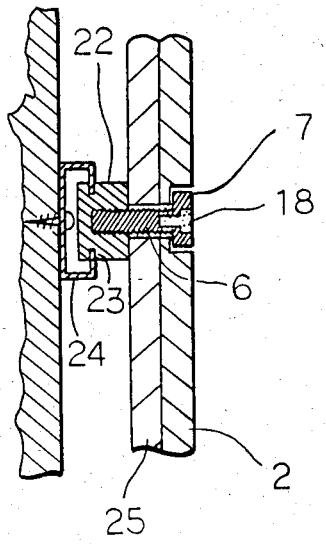
FIG. 6 is a cross-sectional partial view of the present decorative panel hooked on a wall.

FIG. 5 shows another embodiment of the decorative panel, wherein the above mentioned rigid decorative sheets 2 are installed on a substrate board 25 (used as the structural support) by the use of fixing means such as screws 6 and mating means therefor such as internal screw-thread means 15. The substrate board 25 can be a flat board or a flat wall, and the decorative sheets can be screwed thereto by the use of wood screws and as necessary plugs therefor. The flat substrate board 25 can contain holes 26 and nuts 22, and the decorative sheets 2 can be screwed thereto by bolts 6 as illustrated in FIG. 5. The above mentioned nuts 22 can have guide grooves 23 to mate with hooks 24 fixed to a structural member, whereby the decorative panel 1 can be anchored to a structural member such as walls as illustrated in FIG. 6. One of the features of this embodiment is that the decorative sheets 2 are supported and protected by the substrate board 25.

The descriptions on other modifications such as structural supports, fixing means, mating means therefor, accessories and the like appearing in Embodiment I are quoted without repetition, because they can be readily applied to this embodiment by those skilled in the art.

Incidentally, nuts similar to the nuts 13 appearing in FIG. 4 can be fixed to the holes 26 of the substrate board 25. For example, the nut which is similar to the nut 13 but has a flange at one end thereof and preferably an outward opposite-handed screw thread can be set to the hole 26, whereby the decorative sheets 2 can be installed on the both sides of the board 25.

EMBODIMENT III

Other decoration articles 27 can be advantageously set on the surface of the present decorative panel 1 by means of magnetic force, as shown in FIG. 2.

When the decoration article such as decorative or displaying members are small and light, it can be set by a single magnet piece and a magnetizable piece. For example, the bolt 6 or cap 18 fixed to the bolt, as shown in FIGS. 1, 4 and 5, can be a magnet piece and the decoration article can contain a magnetizable piece, and vice versa.

Figure 7:
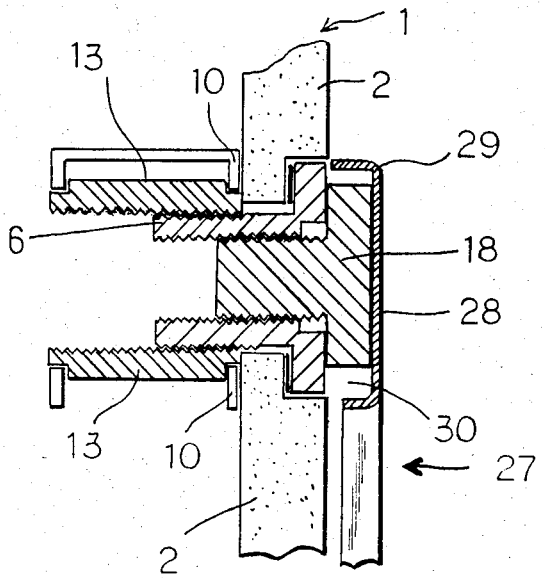
FIG. 7 is a cross-sectional partial view illustrating a picture frame set on the present decorative panel.

According to this embodiment, a picture frame containing magnetizable materials or magnet materials can be readily set and replaced without undecently exposed hanging means. When the picture frame is relatively light, it can be set on the decorative panel by means of plural magnet pieces. When the picture frame is relatively large and heavy, the frame 27 should have a hooking means 29 inside the upper portion thereof, as illustrated in FIG. 7. More specifically, the hook 29 (e.g. in the shape of inverted L or sideway U) at the upper portion of the frame 27 is anchored by the magnet cap 18 fixed to the decorative panel 1 to support the weight of the frame, and the magnetizable metal portions 28 of the frame are horizontally attracted by the magnet cap 18, whereby the picture frame 27 can be secured in both gravitational and horizontal directions. It is preferred that the magnetizable metal portion 28 with the hook 29 has some space 30 or allowance 30 with respect to the magnet cap 18 for easily mounting the frame 27.

Incidentally, the picture frame 27 can have optional configurations and may cover or contain thin articles 31 such as drawings, photographs, posters and documents. The frame 27 itself can also provide three-dimensional decoration effects without such decorative articles. In other words, the picture frame is used in a fashion either to cover the decorative article 31 attached onto the decorative panel or to hold the decorative article therein.

What is claimed is:

1. A decorative panel comprising thin right-angled tetragonal rigid decorative sheets assembled without substantial gaps and replaceably installed on a structural support by the use of fixing means having flanges at the heads thereof; said decorative sheet having substantially quarter-round cutouts at the corners thereof and substantially quarter-round depressions adjacent to the cutouts; each of the corners of four decorative sheets assembled together forming a cut-out hole and a depression around the hole; said structural support containing mating means for the fixing means; the cut-out holes of the assembled sheets being arranged on the mating means; the fixing means being fitted to the mating means through the cut-out holes; the flanges at the heads of the fixing means being recessed on the depressions around the cut-out holes; the heads of the fixing means recessed on the depressions being not higher than the level of the decorative surface of the decorative sheets; the fixing means having an inner hole at the head thereof and the inner holes holding therein a decorative cap, a soft cap for pinning, a hook, a hanger, a magnet or magnetizable piece, and/or a rod for supporting a shelf.

2. The decorative panel according to claim 1, in which the fixing means is a screw.

3. The decorative panel according to claim 1 in which a covering frame is applied onto an edge or edges of the decorative panel, where fixing with the fixing and mating means is not needed.

4. The decorative panel according to claim 1 in which the decorative sheet is a ceramic tile having the depression at the corners thereof in the form of an inclined plane tapering down towards the cut-out.

5. The decorative panel according to claim 1 in which the decorative panel composes a decorative wall secured onto a structural member.

6. The decorative panel according to claim 1 in which the decorative panel is a self-standing screen.

7. The decorative panel according to claim 1 in which the decorative sheets are installed on both sides of the structural support.

8. The decorative panel according to claim 1 in which the structural support comprises bars having internal screw-thread holes or holes combined with nuts.

9. The decorative panel according to claim 8 in which the structural support is in the form of a frame work comprising the bars.

10. The decorative panel according to claim 8 in which the bar is a bar having U-shaped cross-section fixed with the opening thereof downward, upward or sideways.

11. The decorative panel according to claim 1, in which the structural support is a substrate board containing internal screw-thread holes or holes combined with nuts.

12. The decorative panel according to claim 11 in which the mating means for the fixing means are nuts having guide grooves for anchoring the decorative panels to hooks fixed onto a structural member.

13. The decorative panel according to claim 1 in which a decoration article is set on the surface of the decorative panel by means of a magnet piece or magnetizable piece held in the inner hole of the fixing means.

14. The decorative panel according to claim 13 in which the decoration article is a picture frame having a hooking means to be anchored by the magnet piece inside the upper portion thereof, whereby the picture frame is secured in both gravitational and horizontal directions.

15. The decorative panel according to claim 14 in which the hook has some space or allowance inside the upper portion with respect to the magnet piece for easily mounting the picture frame.

16. A decorative panel comprising thin right-angled tetragonal rigid decorative sheets assembled without substantial gaps and replaceably installed on a structural frame work by the use of fixing screw means having flanges at the heads thereof; said decorative sheet having substantially quarter-round cutouts at the corners thereof and substantially quarter-round depressions adjacent to the cutouts; each of the corners of four decorative sheets assembled together forming a cut-out hole and a depression around the hole; said frame work containing mating means for the fixing means; the cut-out holes of the assembled sheets being arranged on the mating means; the fixing means being fitted to the mating means through the cut-out holes; the flanges at the heads of the fixing means being recessed on the depressions around the cut-out holes; the heads of the fixing means recessed on the depressions being not higher than the level of the decorative surface of the decorative sheets; the fixing means having an inner hole at the head thereof and the inner holes holding therein a decorative cap, a soft cap for pinning, a hook, a hanger, a magnet or magnetizable piece, and/or a rod for supporting a shelf; said frame work consisting essentially of horizontal or vertical bars arranged at an interval of the decorative sheet and at least two vertical or horizontal bars supporting the former bars; and said mating means on the frame work being internal screw-thread holes or nut-containing holes set at an interval of the decorative sheet.

17. The decorative panel according to claim 16 in which the decorative sheet is a ceramic tile having the depression at the corners thereof in the form of an inclined plane tapering down towards the cutout.

18. A decorative panel comprising thin right-angled tetragonal rigid decorative sheets assembled without substantial gaps and replaceably installed on the both sides of a structural frame work by the use of fixing screw means having flanges at the heads thereof; said decorative sheet having cutouts at the corners thereof and depressions adjacent to the cutouts; each of the corners of four decorative sheets assembled together forming a cut-out hole and a depression around the hole; said frame work containing mating means for the fixing means; the cut-out holes of the assembled sheets being arranged on the mating means; the fixing means being fitted to the mating means through the cut-out holes; the flanges at the heads of the fixing means being recessed on the depressions around the cut-out holes; the heads of the fixing means recessed on the depressions being not higher than the level of the decorative surface of the decorative sheets; said frame work consisting essentially of horizontal or vertical bars having U-shaped cross-section and at least two vertical or horizontal bars supporting the U-shaped bars; said mating means being nuts having ring projections at th both ends thereof held between pairs of the holes set on the both parallel sides of the U-shaped bar; whereby the decorative sheets being readily and replaceably installed on the both sides of the frame work.

19. The decorative panel according to claim 18 in which the fixing means has an inner hole at the head thereof and the inner holes hold therein a decorative cap, a soft cap for pinning, a hook, a hanger, a magnet or magnetizable piece, and/or a rod for supporting a shelf.

20. The decorative panel according to claim 18 in which the cutouts and depressions of the decorative sheet have substantially quarter-round shapes.

* * * * *